US005273329A

United States Patent [19]

Wessel

[11] Patent Number: 5,273,329

[45] Date of Patent: Dec. 28, 1993

[54] RETRIEVAL AND LITTER PICK TOOL

[76] Inventor: Mary M. Wessel, 2810 Meadow Dr., Louisville, Ky. 40220

[21] Appl. No.: 979,528

[22] Filed: Nov. 20, 1992

[51] Int. Cl.[5] ..... B66C 1/00; B08B 1/00

[52] U.S. Cl. ..... 294/61; 294/1.1; 294/24

[58] Field of Search ..... 294/2, 1.1, 15, 19.1, 294/24, 51, 61, 121, 65.5

[56] References Cited

U.S. PATENT DOCUMENTS

| | | | |
|---|---|---|---|
| 27,615 | 3/1860 | Byrn . | |
| 39,128 | 7/1863 | Dick . | |
| 481,724 | 8/1892 | Westover . | |
| 517,295 | 3/1894 | Pulling . | |
| 939,476 | 11/1909 | Copp | 294/1.1 X |
| 1,437,252 | 11/1922 | Kinnaird . | |
| 1,538,867 | 5/1925 | Garvin . | |
| 1,635,259 | 7/1927 | Critchley . | |
| 1,665,988 | 4/1928 | Smith | 294/1.1 X |
| 2,428,864 | 10/1947 | Boyd . | |
| 2,597,400 | 5/1952 | Stogsdill et al. | 294/2 |
| 2,600,981 | 6/1952 | Fahey . | |
| 2,610,882 | 9/1952 | Sutliffe . | |
| 2,642,306 | 6/1953 | Beeler . | |
| 2,695,188 | 11/1954 | Klausman et al. . | |
| 2,717,800 | 9/1955 | Chatten | 294/61 X |
| 3,492,033 | 1/1970 | Mueller . | |
| 3,526,424 | 9/1970 | Torres . | |
| 3,556,577 | 1/1971 | Brasseur . | |
| 3,623,179 | 11/1971 | Roth . | |
| 3,797,875 | 3/1974 | den Hamer . | |
| 3,864,993 | 2/1975 | Hovind . | |
| 4,073,530 | 2/1978 | Seidler . | |
| 4,079,983 | 3/1978 | Van Mastrigt . | |
| 4,083,075 | 4/1978 | Hester . | |
| 4,098,442 | 7/1978 | Moore . | |
| 4,183,570 | 1/1980 | Broyles et al. . | |
| 4,209,929 | 7/1980 | Mishima | 294/61 X |
| 4,502,722 | 3/1985 | Rocquin . | |
| 4,653,789 | 3/1987 | McWilliams et al. | 294/19.1 X |
| 4,699,411 | 10/1987 | Scott | 294/61 |
| 4,740,023 | 4/1988 | Miller | 294/61 X |
| 4,856,835 | 8/1989 | Pacione . | |
| 4,909,554 | 3/1990 | Pacione . | |
| 4,953,902 | 9/1990 | Brown . | |
| 4,975,649 | 12/1990 | Barouh et al. . | |
| 5,181,755 | 1/1993 | Stanwich et al. | 294/1.1 |

FOREIGN PATENT DOCUMENTS

| | | |
|---|---|---|
| 600987 | 2/1926 | France . |
| 2231248 | 11/1990 | United Kingdom . |

*Primary Examiner*—David M. Mitchell
*Assistant Examiner*—Dean J. Kramer
*Attorney, Agent, or Firm*—Wood, Herron & Evans

[57] ABSTRACT

A retrieval and litter pick tool includes an elongated handle, a spike extending longitudinally therefrom and having an irregular surface, a spike shield, and an adhesive tube selectively mounted on the spike by the shield. Alternately, the adhesive tube is directly mounted on the spike. The spike pierces and removable holds penetrable items for retrieval from penetrable surfaces or other surfaces where penetration is not limited, and the adhesive tube presents an adhesive face for retrieving penetrable or impenetrable items from any surface.

5 Claims, 1 Drawing Sheet

RETRIEVAL AND LITTER PICK TOOL

FIELD OF THE INVENTION

This invention relates to retrieval tools and in particular to an improved pick-type retrieval hand tool with multiple uses.

BACKGROUND

It is well known to use hand tools having a smooth, pointed spike to pick up penetrable objects. Such tools generally include an elongated handle with a smooth spike extending from one end. The spike is driven through an object, such as penetrable litter, leaves, and the like. The tool is then lifted to retrieve the pierced item, and deposit it in a collection bin, or the like.

One of the difficulties with such a tool is that items tend to fall off the spike before they can be retrieved or deposited. This occurs particularly with heavy items, or with frangible items such as dried leaves, especially when a number of them are pierced prior to retrieval or deposit. For example, when such a tool is used by a clean-up crew to pick up automobile tires, the weight of the tire, together with the weight of any water in it, makes effective retrieval with such a tool impossible.

It is also well known to use magnetic or adhesive devices to retrieve or pick up impenetrable objects. Where hand-held tools are concerned, these are limited to light duty use, and cannot be generally used for multiple item pick-up or for picking up heavy items like old automobile tires, or a multiplicity of items, like leaves, paper or litter, before unloading the tool.

Despite these prior devices, there exists a continuing need for a pick-up or retrieval tool useful to older or handicapped persons who may have difficulty in bending, stooping or reaching to pick up items out of reach, or which are on a difficult surface such as the ground, a carpet or a hard smooth surface.

There is also a need for a tool which can be easily used to pick up items not swept up by a vacuum cleaner, such as paper clips or staples lying in or on a previously vacuumed carpet.

Accordingly, it is one objective of this invention to provide a compact tool for the aged and handicapped for retrieving objects of unlimited types from any surface.

Another objective of this invention has been to provide an improved litter pick tool for litter crews and others for picking up litter from any surface.

Another objective of this invention has been to provide a tool capable of piercing, dragging and lifting heavy items such as water-filled automotive tires.

Another objective of this invention has been to provide a low cost, multiple-use retrieval tool for handling penetrable and impenetrable objects on any surface.

Yet another objective of the invention has been to provide a tool capable for retrieving small items from carpeting containing only occasional litter to thereby avoid overall vacuuming which is otherwise unneeded, thereby conserving energy.

To these ends, a preferred embodiment of the invention comprises an elongated handle with a spike extending from one end wherein the spike has an irregular surface such as threads, grooves, flanges or the like. This irregular surface spike is used to retrieve penetrable items such as paper, leaves, automobile tires and the like from penetrable surfaces. The irregular spike surface acts to retain pierced objects on the spike until positively ejected therefrom. The surface is also capable of retaining heavier items, such as automobile tires, until forcibly rejected.

A spike cover is provided to serve as a protective shield to prevent injury when the tool is not in use. In addition, the cover functions as an adaptor used in converting the tool to an adhesive retrieval tool.

More specifically, an adhesive dispensing cartridge containing an adhesive material is press-fitted over the adaptor. The cartridge cover can be pulled off, exposing an adhesive face. This face can be pressed against any number of objects lying on any type of surface to adhere the objects and pick them up.

Many objects can be so retrieved before the adhesive material loses its tackiness due to dust or other contaminations on the object or surfaces exposed to the adhesive. When contamination does occur, pinching or shallow kneading of the adhesive surface will revitalize its tacky nature. After repeated cycles, the adhesive is slightly advanced from the cartridge and a forward surface sliced off, exposing a virgin adhesive face.

Preferably, the adhesive material is pliable enough to conform to irregular surfaces of objects such as scissors and pocket knives, for example. This feature is particularly advantageous for the infirm, handicapped, bed-ridden or wheelchair bound population.

Accordingly, in a preferred embodiment, the invention contemplates an improved pick-up tool having a threaded spike to enhance its lifting and pick-up capabilities and a multiple function glue or adhesive adaptor for use in picking up impenetrable items from any surface or penetrable or impenetrable items from non-penetrable surfaces.

These and other objectives and advantages will become readily apparent from the following detailed description of preferred and alternative embodiments of the invention and from the drawings in which.

SPECIFICATION

Figure 1:
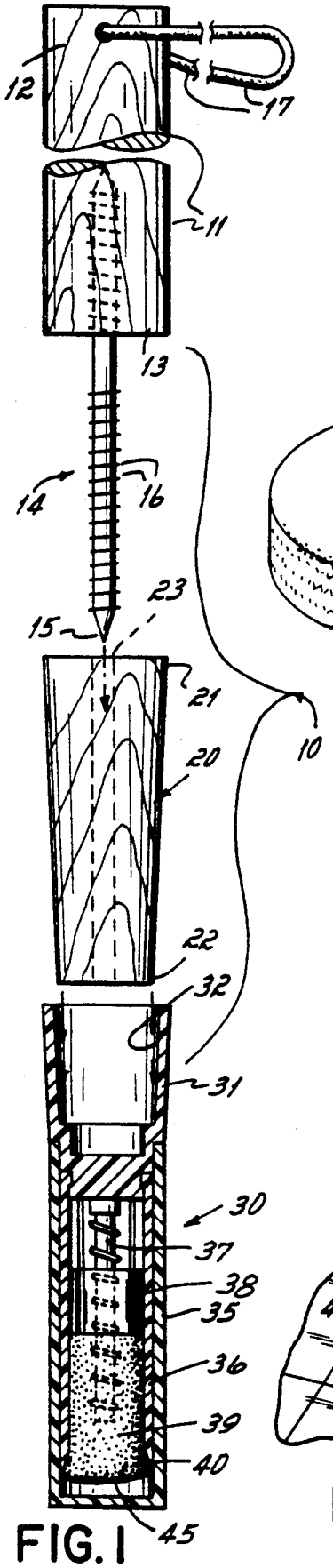
FIG. 1 is an exploded elevational view of a preferred embodiment of the invention in partial cross-section.

Turning now to FIG. 1 of the drawings, there is shown therein an exploded view of a retrieval and pick-up tool according to the invention. The tool 10 includes in combination an elongated handle 11, a spike 14, a spike cover or shield means 20 and an adhesive cartridge 30. In more detail, the handle 11 is an elongated handle or shank having an upper end 12 and a lower end 13, from which extends the elongated spike 14.

Spike 14 preferably has a pointed end 15. Between the pointed end and the handle, the spike is provided with an irregular surface 16, such as threads, grooves or a plurality of transverse or radical flutes or flanges. Threads 16 are shown.

A lanyard 17 is looped through the upper end 12 of the handle 11 so that a user of the tool 10 may slip his wrist through the lanyard 17 to keep from dropping it.

The handle 11 and spike 14 traverse or extend a distance of three or four feet, for example, but can be any suitable length.

In the preferred embodiment of the invention as shown in FIG. 1, a spike cover 20 is provided and serves two functions. First, it will be appreciated that the spike cover 20 is tapered from a large diameter end 21 to a smaller diameter end 22. The spike cover has an internal passage 23, which is preferably cooperatively threaded to receive the spike 14 in threaded engagement so that the cover is held positively on the spike. Otherwise, the cover 20 may be fit over the spike 14 and removably held thereon by the other irregular type surface on the spike, whatever is used.

Again, it will be appreciated that the irregular surface 16 is comprised of threads which may be either threads provided on the spike with a constant diameter shank or tapered wood screw-type threads or any other extending irregularities which tend to prevent the removal of items which are pressed over the spike or through which the spike punctures.

Returning to the cover 20, it may be twisted onto the spike and removably held thereon, thus serving the first function of preventing injury by the uncovered spike when the tool is not in use, for example. In this regard, it will be appreciated that the cover 20 may be slightly longer than the spike and certainly long enough to extend over and cover the pointed end 15 of the spike.

It will also be appreciated from FIG. 1 that an adhesive cartridge 30 can be selectively utilized in combination with the tool. The adhesive cartridge 30 is provided with a rotatable end piece, cap, or skirt 31 which has an internal tapered bore 32. Bore 32 is sized to cooperate with the taper on the outer surface of the spike cover 20 so that the adhesive cartridge 30 can be removably press-fitted onto the spike cover.

The adhesive cartridge 30 further includes an outer removable cover 35 and an inner glue or adhesive surrounding sleeve 36. The end 31 is attached to a threaded rod 37 which may be formed as an integral piece. Sleeve 36, at its end adjacent the end cap 31, is fitted to the cap, so that there can be relative rotation between the cap 31 and the sleeve 36. As the cap 31 is turned relative to the sleeve 36, the threaded rod 37 also turns relative to the sleeve 36. Threaded onto the rod 37 is a pusher 38, which is located immediately adjacent a bulk supply 39 of adhesive within the sleeve 36. The outer periphery of the pusher 38 is grooved to interfit with elongated projections disposed internally of and along the sleeve 36. As the end cap 31 is turned relative to the sleeve 36, the pusher 38 translates along the threaded rod 37. When the pusher translates toward the end 40 of the sleeve 36, it will be appreciated that it is operable to push adhesive 39 toward and out of the end 40.

The particular adhesive cartridge may be any suitable adhesive cartridge which contains a malleable, tacky adhesive. The adhesive cartridge may comprise any other adhesive means which can be removably secured to the spike 14, such as a pad comprising in part, pressure sensitive adhesive or any other type of adhesive device.

One particular adhesive cartridge which has been found suitable is the adhesive or glue stick sold by the Kinko Service Corporation of Ventura, Calf. Other glue sticks or cartridges could be used and adapted to the invention as well.

Figure 4:
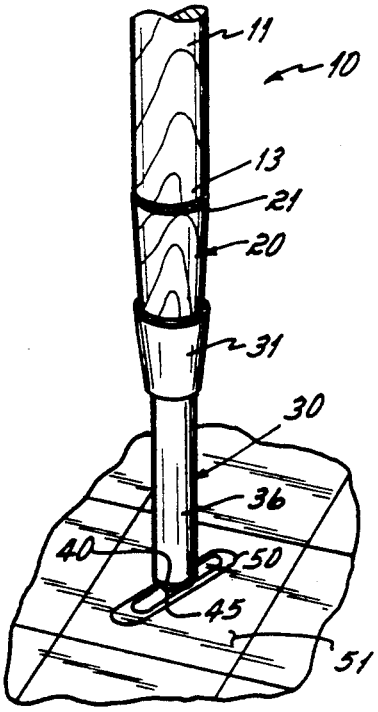
FIG. 4 is a diagrammatic view of the invention illustrating retrieval of a paper clip by means of the attached adhesive cartridge.

It will also be appreciated that when the outer cover 35 is removed from the glue cartridge 30, a surface or face 45 of adhesive is presented by the glue cartridge 30 in an uncovered fashion, so that it can be used to engage and pick up items to which the user applies the cartridge 30. Accordingly then, when used to pick up or retrieve items by the adhesive cartridge 30, the components of the invention in FIG. 1 are all assembled, with the spike cover 20 being mounted on the spike 14 and the adhesive cartridge 30 being removably press-fit over the cover 20. The cover 35 is then removed and an item is picked up or retrieved by means of engagement of the face 45 of adhesive against the item to be retrieved, such as illustrated in FIG. 4 of the drawings. In FIG. 4, it will be appreciated that the invention is illustrated in use to pick up or retrieve a paper clip 50 from a hard surface 51. Neither the paper clip nor the hard surface 51 is generally penetrable, so in this instance in FIG. 4, the invention is illustrated to functionally pick up and retrieve an impenetrable object from an impenetrable surface.

Figure 2:
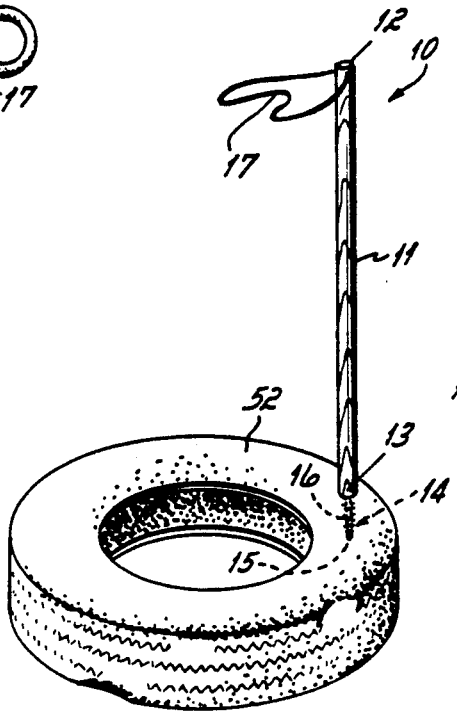
FIG. 2 is a diagrammatic view of the invention as in FIG. 1 but with the adhesive cartridge and shield removed and the tool in use in retrieving a tire.
Figure 3:
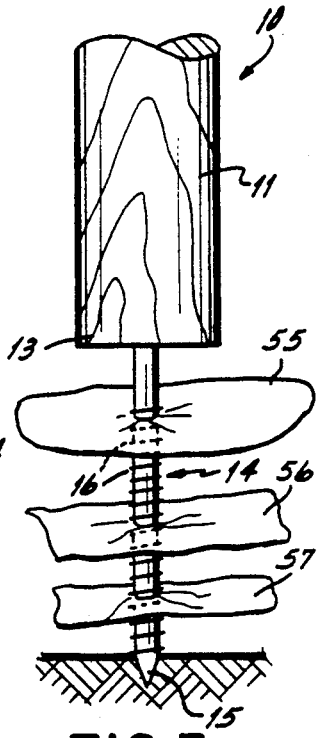
FIG. 3 is a view similar to FIG. 2 but illustrating retrieval of penetrable leaves from a penetrable surface such as the ground.

Turning now to FIGS. 2 and 3, it will be appreciated that these figures show the utilization of the tool 10 for retrieving or picking up penetrable objects. In FIG. 2, the spike 14 is rammed through a tire 52, with the point 15 serving to facilitate penetration of the spike 14 into the tire. After penetration, the tool handle can be turned to cause the threaded portion 16 of the spike 14 to more tightly engage the tire material surrounding the spike. Whether turned or not, the irregular surface 16 on the spike 14 helps to maintain the tire on the spike, as the tool 10 is lifted or retrieved to thereby lift or drag the tire. Accordingly, it will be appreciated that the tool 10 is selectively used to lift or retrieve items which can be penetrated by the spike 14. Such penetration can also be used to create a drain hole so water in the tire is drained when the tire is turned over.

Looking at FIG. 3, the tool 10 is utilized to collect leaves, litter or other debris which are penetrable. Leaves are illustrated at 55 56 and 57 in FIG. 3 and are being picked up from a penetrable ground surface. In this use, the tool is projected through the leaves or other litter and the point 15 of the tool might also extend into the penetrable surface of the ground. Thereafter, the tool is withdrawn, with the irregular surface 16 functioning to hold the leaves or litter 55, 56 and 57 on the spike 14, without falling off. Accordingly, FIG. 3 illustrates utilization of the tool to pick up and/or retrieve penetrable items from a penetrable surface.

Of course, it will be appreciated that the tool can be useful in a number of other pick-up and retrieval environments other than those specifically shown in the figures. For example, non-penetrable or penetrable items could be picked up by virtue of the use of the adhesive cartridge 30 assembled with the tool. For example, the tool is useful in picking up paper clips or staples from a carpeted surface so as to avoid an overall vacuuming when only a few items, such as staples for example, are on the carpet. This conserves a good deal of energy by elimination of a vacuuming cycle. On the other hand, penetrable or impenetrable objects could be picked up from penetrable surfaces. For example, the adhesive cartridge 30 could be utilized to pick up leaves or litter or impenetrable items off the ground, for example, were that operation desired.

It will also be appreciated that irregular surface 16 of the spike 14 serves to help maintain heavy items on the spike when the spike penetrates those items, whether or not the spike is twisted after such penetration. In addition, the irregular surface 16 serves to hold multiple light-weight frangible items, such as dried leaves, on the spike after they have been pierced.

When cartridge 30 is being used, it will be appreciated that eventually the face 45 of the adhesive may lose its tackiness as a result of the accumulation of dust, foreign matter or other contamination on the face 45. When this occurs, it is only necessary to lightly knead or pinch the adhesive face 45 and re-flatten it to revitalize its tacky nature. When such kneading or pinching no longer suffices to provide the tackiness desired, it is only necessary to twist the sleeve 36 with respect to the cap 31 to slightly advance the adhesive out of the end 40 of the sleeve 36. Thereafter, a forward portion of the adhesive which has been advanced may be cut off to expose a totally fresh or virgin adhesive face.

Figure 5:
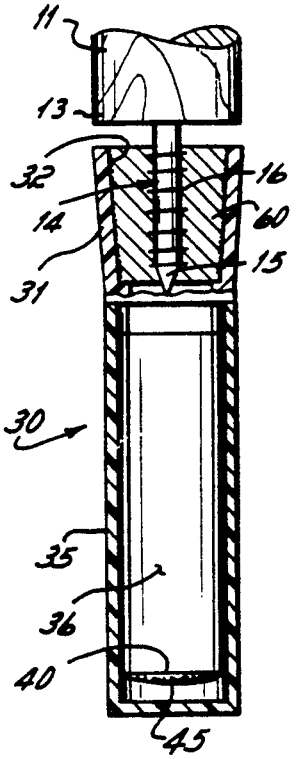
FIG. 5 is a cross-sectional view of an alternative embodiment of the invention of FIG. 1 showing the adhesive cartridge mounted directly to the threaded spike.

Turning now to an alternative embodiment as shown in FIG. 5, the tool handle 11 and spike 14 are illustrated therein. In this embodiment, however, the cartridge 30 is provided with a solid-ended skirt or end cap 31 with the hollow area or bore 32 filled in by a plug 60, which may comprise an integral part of the cartridge 30. In this embodiment, it is unnecessary to utilize a separate spike cover 20 in order to attach the handle 11 and spike 14 to the cartridge 30. All that is necessary is to twist the cartridge 30 onto the spike 14, where it is secured in place for use to adhesively pick up or retrieve items as described above.

It will be appreciated that the tool 10 has many effective uses. It can be used, for example, by the aged, infirmed or handicapped persons to pick up many different items which are out of their normal reach. The adhesive face 45 can be pushed over irregular surfaces such as the surfaces of scissors, sewing implements, eating utensils or the like, when those must be retrieved. As well, the tool 10 is useful by professional cleanup crews and gatherers of litter around parks and waterways for maintaining those areas free of litter through either the use of the uncovered spike 14 or the use of the adhesive cartridge 30 thereon.

These and other advantages and modifications will become readily apparent to those of ordinary skill in the art without departing from the scope of this invention, and the applicant intends to be bound only by the claims appended hereto:

I claim:

1. A retrieval tool for retrieving articles and comprising:

an elongated shank;

a spike extending from one end of said shank in the same direction as the extension of the shank;

said spike having a pointed end for piercing articles and an irregular surface for resisting removal of articles pierced by said spike;

an adhesive means presenting an exposed adhesive surface, said adhesive means being mountable on said spike; and wherein said adhesive means includes an adhesive cartridge containing a selectively advanceable bulk adhesive.

2. Apparatus as in claim 1 wherein said adhesive means is directly secured to said spike.

3. Apparatus as in claim 1 further including a shield means removably mounted on said spike for covering said spike when said tool is not in use.

4. A retrieval tool for retrieving articles and comprising:

an elongated shank;

a spike extending from one end of said shank in the same direction as the extension of the shank;

said spike having a pointed end for piercing articles and an irregular surface for resisting removal of articles pierced by said spike;

an adhesive means presenting an exposed adhesive surface, said adhesive means being mountable on said spike; and an adapter means for removably mounting said adhesive means on said spike, said adapter means being secured to said spike, said adhesive means being removably mounted on said adapter means.

5. A multiple function retrieval tool for retrieving penetrable and impenetrable articles from both penetrable and impenetrable surfaces and comprising in combination:

an elongated handle;

a spike extending longitudinally from one end of said handle;

said spike having a pointed end for piercing articles and an irregular surface for resisting removal therefrom of articles penetrated by said spike;

an adhesive means for presenting an adhesive pick-up surface to articles to be retrieved; and means for selectively securing said adhesive means to said irregular surface of said spike.

* * * * *